US005739461A

United States Patent [19]

Jacobson

[11] Patent Number: 5,739,461

[45] Date of Patent: Apr. 14, 1998

[54] LAUNCHER

[75] Inventor: Michael D. Jacobson, Ridgecrest, Calif.

[73] Assignee: Quoin, Inc., Ridgecrest, Calif.

[21] Appl. No.: 804,036

[22] Filed: Feb. 24, 1997

Related U.S. Application Data

[63] Continuation-in-part of Ser. No. 598,246, Feb. 8, 1996.

[51] Int. Cl.[6] ..... F42B 4/26; F42D 3/00

[52] U.S. Cl. ..... 102/338; 102/342; 102/345; 102/302

[58] Field of Search ..... 102/302, 338, 102/342, 345

[56] References Cited

U.S. PATENT DOCUMENTS

| | | | |
|---|---|---|---|
| 2,354,025 | 7/1944 | Johnson | 102/342 X |
| 2,925,038 | 2/1960 | Walker | 102/302 |
| 3,628,416 | 12/1971 | Kernan | 102/342 X |
| 3,921,325 | 11/1975 | Tennigkett | 102/342 X |
| 4,023,493 | 5/1977 | Austin et al. | 102/22 |
| 4,526,105 | 7/1985 | Herren, Jr. | 102/342 X |
| 5,551,345 | 9/1996 | Wardecki et al. | 102/342 X |

OTHER PUBLICATIONS

Ground Ignition Systems: An Equipment Guide for Prescribed and Wild Fires. U.S. Government publication by U.S. Dept. of Agriculture, Forest Service, Technology & Development Program, 5100–Fire, Mar. 1993, 9351–2806–MTDC.

*Primary Examiner*—Peter A. Nelson
*Attorney, Agent, or Firm*—Kenneth G. Pritchard

[57] ABSTRACT

A pistol style flare launcher device suitable for multiple launches of flares uses an orifice in a gas duct to control the burn rate of blank cartridges by predictable high back pressure and a deflector pin in the launcher barrel to block gas from said orifice from striking the flare and deflect the gas into a plenum which allows gas to expand to a lower pressure still suitable to launch the flare.

4 Claims, 2 Drawing Sheets

LAUNCHER

This application is a Continuation-in-Part of application Ser. No. 08/598,246, filed Feb. 8, 1996.

BACKGROUND OF THE INVENTION

This invention relates to incendiary devices to initiate firebreaks and the like. More particularly it relates to launchers of incendiary devices that permit brush fires to be started remotely from the person controlling the device.

Forest and brush fires are major problems for both the communities and firefighters that have to deal with them on a regular basis, such as the western part of the United States. Forest fires can be either controlled or prevented by intentionally igniting fires. As a control mechanism, a fire can be set to burn off accumulated fuel during a season where there is little chance of creating an uncontrolled fire. This is called a controlled burn. The following description is for the control of wild fires, although, similar conditions exist for the controlled burn. For most of these fires, the goal is to gain control as quickly as possible. One technique regularly employed to establish control is the backfire where areas in the fire's path are burned to deprive the fire of fuel thereby creating a buffer zones that impedes the fires. A large variety of devices have been used to start these backfires. A partial list includes matches, electric lighters, hand-thrown devices, fuses, drip torches, plastic bags of gelled fuel, canister devices, pneumatic torches, propane torches, power flame throwers, flare pens, signal pistols, and various launching devices. Launching devices range from compressed air to slingshots.

For a detailed description of all of these devices with warnings about their dangers and limitations, the United States Department of Agriculture, Forest Service, has a detailed book called "Ground Ignition Systems: An Equipment Guide for Prescribed and Wild Fires." In summary all current devices have severe restrictions. Setting a backfire is a race against time. An out of control fire is advancing towards the firefighters in the area of a designated backfire location. The firefighters first have to assure that the fire they are starting will burn in a direction they can control. Next the firefighters have to start the backfire over a large enough area and give it adequate time to burn away from the fire line they have set to define the backfire and towards the fire to be controlled.

In order for the firefighters to burn large areas, it is necessary to first light a small continuous fire adjacent to a trail or road, then launch flares beyond the small fire line. The launched flares produce a fire that will draw the smaller fire line towards it. The combination produces a fire line of considerable width.

In general, state of the art devices for launching flares or other ignition devices have proved to be limiting. For example, compressed air devices are heavy and slow to move around. Pen flare launchers while highly mobile have proven to have very limited fire starting capability. Several of the other fire starting devices require a firefighter to take the device to the stage where the fire is to be started. This leads to firefighters walking inside the fire line starting the extension fires. Such activity puts the firefighter at increased personal risk, especially when the terrain is very rough.

Thus the prior techniques required coordination of equipment, protection of explosive/combustive materials in the midst of a fire area, and the time of assuring fires were started along a fire line in an adequate time.

SUMMARY OF THE INVENTION

Accordingly, the general purpose of the present invention is to provide a launcher which is easily mobile, does not require a firefighter to be at the exact location to assure delivery of a flare, and provides for multiple launches before reloading.

One embodiment of the invention uses a launcher barrel mounted on a pistol mount design which includes hand grip, trigger, hammer, and cylinder. Blank cartridges can be loaded into the cylinder and fired by a conventional trigger-hammer combination such as exists in a starter pistol. To create a resistance to gas flow, an orifice in a gas duct produces high pressure in the blank cartridge to properly burn the gun powder. To prevent the blank from rupturing the flare, a pin is enclosed in the launcher barrel between the flare and the cartridge. When the cartridge is fired, the pin deflects the direct fire of the cartridge and allows the pressure built up to launch the flare a safe distance.

DESCRIPTION OF THE PREFERRED EMBODIMENT

Figure 1:
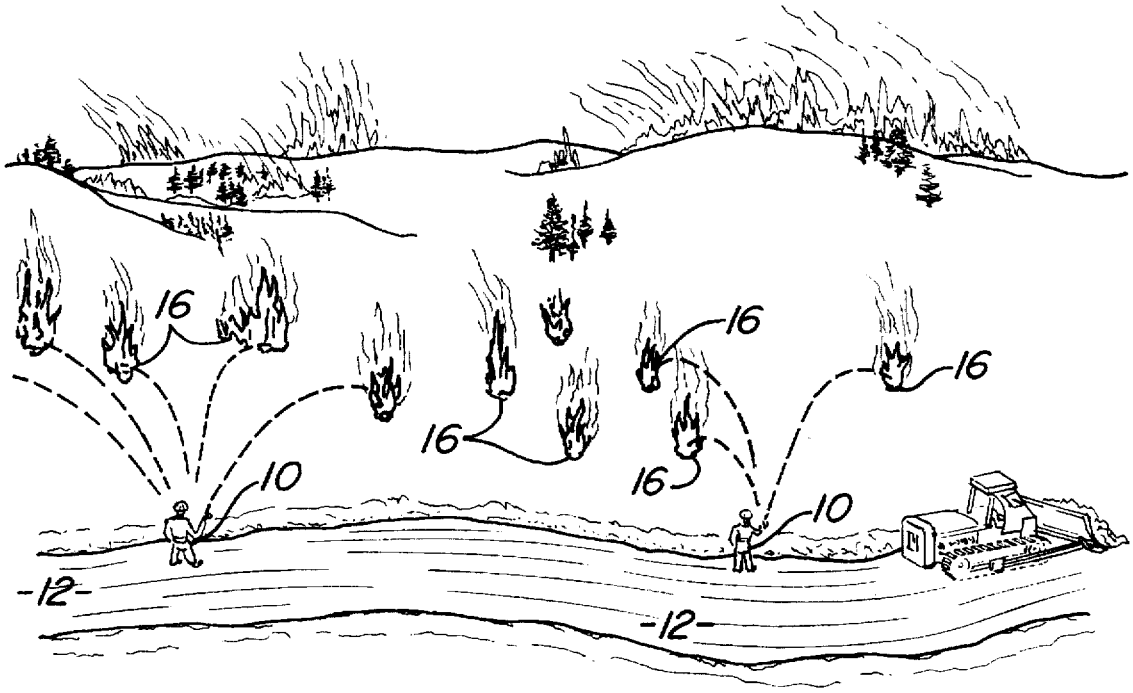
FIG. 1 is a map of a typical fire line.

FIG. 1 is an area view of how a single firefighter can start backfires over a large area. Firefighter 10 may stand behind a fire line 12 which has been cleared as necessary to allow a backfire to be started. Very small fires, not shown, may be started along the upper edge of the fire line 12 in the usual manner to be drawn to the bulk of the backfire started further in from fire line 12. Using launcher 14 shown in a later figure, firefighter 10, can place a pattern of incendiary flares at locations 16 to start a backfire. The shown pattern of locations 16 is arbitrary and is expected to vary as needed to light the backfire. Should any individual location fail to ignite from a flare, multiple launches of other flares can be made. Thus, firefighter 10 actually improves the chances of a successful start of a backfire by remaining in one place. Any location 16 that does not ignite does not require firefighter 10 to backtrack along a fire line 12 to a location that may have failed to ignite or continue to burn once started. Firefighter 10 never has to be in the area of the backfire which adds safety as well as speed to this method of starting a backfire.

Figure 2:
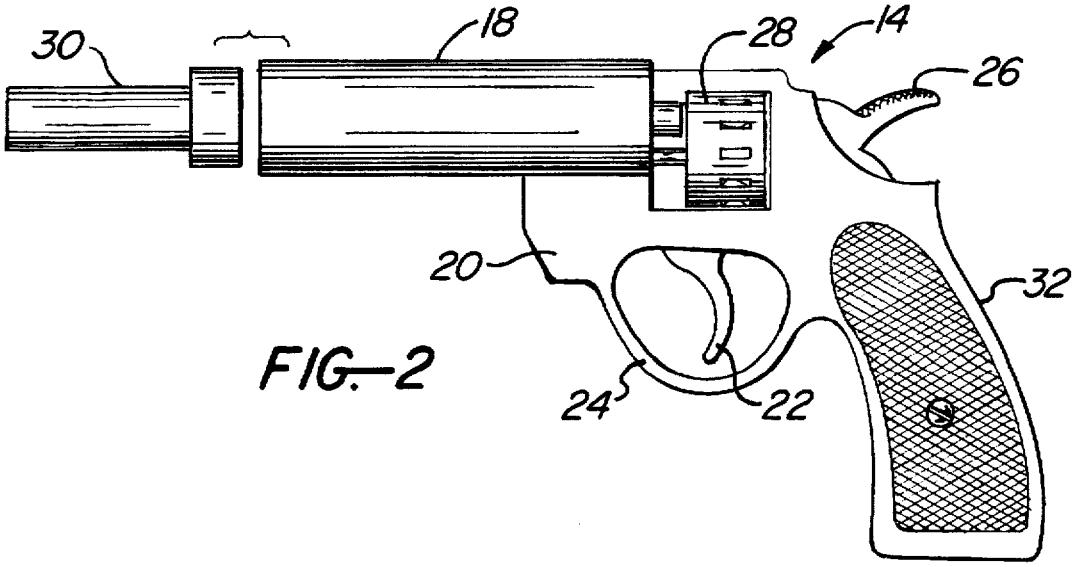
FIG. 2 is a side view of the present invention.

FIG. 2 is a side view of a launcher 14. Launcher 14 has a launcher barrel 18 with one of its two ends mounted on a pistol mount 20. Pistol mount 20 may be modeled on a starter pistol or other well known pistol design. Pistol mount 20 includes a trigger 22. Trigger 22 may have a trigger guard 24 as is well known in pistol design. Trigger 22 is operable connected to a hammer 26. Again the use of triggers to activate a firing hammer is well known and any of the known ways to connect a trigger to a hammer may be used. Also well known is having a cylinder 28 operable connected to trigger 22 and hammer 26 so that cylinder 28 rotates a fixed amount each time trigger 22 is pulled. A flare 30 is also shown which slides into launcher barrel 18 from the opposite end of launcher barrel 18 attached to pistol mount 20. A portion of pistol mount 20 is a pistol grip 32 which is shaped to be hand held in the tradition of any pistol. Pistol mount 20 may be made of the same materials, steel, aluminum, and plastic used in the pistols.

Figure 3:
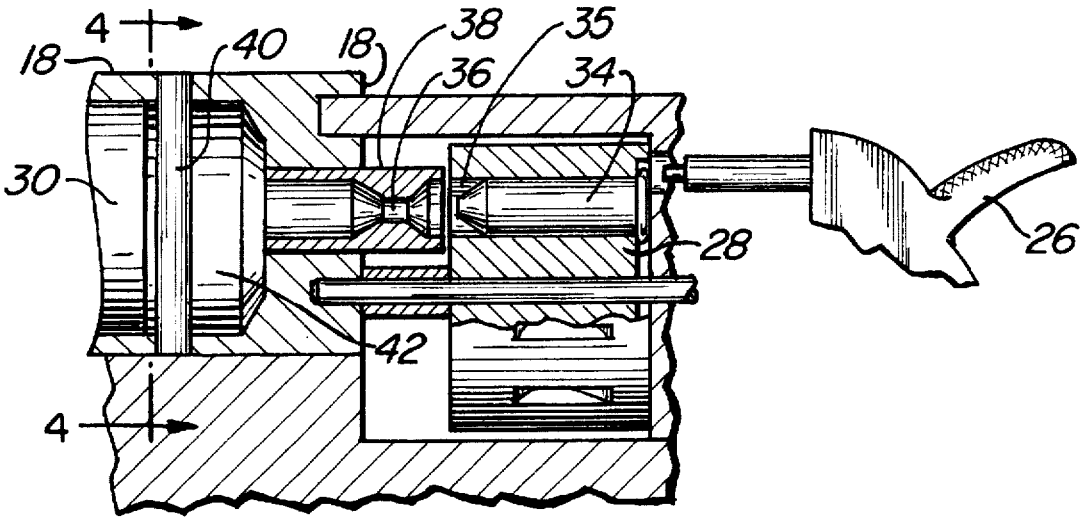
FIG. 3 is a cutaway view of the present invention.

FIG. 3 is a cutaway view of a portion of launcher 14. Cylinder 28 is shown in cutaway which shows a blank cartridge 34 which is one of several that can be placed in cylinder 28 within openings 35 such that a new blank cartridge aligns with hammer 26 every time trigger 22, shown previously, is pulled or hammer 26 is cocked. The number of pulls or cockings before cylinder 28 completes a full revolution is a matter of design well known in the art. Both methods of rotating cylinder 28, either by hammer 26 or trigger 22, are well known. For the present invention nine blank cartridges 34 may be loaded into cylinder 28 at one time. The design may be varied. Historically blanks are fired for the noise or theatrical effect. The quality of the burn of the powder in a blank was not considered of interest. Only in construction equipment, such as nail drivers, have blanks been used to drive pistons or the like. If blank cartridge 34 is fired into an open barrel that is the same size as the blank itself, the powder in blank cartridge 34 will not burn properly. As a result, the pressure available to launch flare 30 is insufficient. The variation in burn results in flares being launched unpredictable distances.

To control the burn rate of the gun powder in blank cartridge 34 in a predictable manner, it was found that the insertion of an orifice 36 in a gas duct 38 aligned with blank cartridge 34 would create adequate back pressure to create a predictable burn rate. The restriction of gas flow simulates the effect of a piston, raising the pressure in blank cartridge 34 when it fires. Blank cartridge 34 must burn at a pressure above 10,000 psi to produce predictable behavior for flare 30 launches. If orifice 36 is too small, the pressure can be made too great and the back end of blank cartridge 34 will blow-out. The best known fire-starting flares however cannot withstand pressure much greater than 700 psi. Thus, if gas duct 38 funnels pressure from blank cartridge 34 into launcher barrel 18 directly onto flare 30, flare 30 ruptures and fails. Insertion of a pin 40 into launcher barrel 18 permits the direct gas path to be blocked from touching flare 30. Pin 40 is placed a set distance away from gas duct 38 so as to create a plenum 42 which is a space for expansion of gas behind flare 30. This volume increase and the flow restricting effect of the orifice allows the relatively high pressure needed to burn blank cartridge 34 to be converted into the relatively low pressure needed to launch flare 30. Pin 40 also serves as a stop to place flare 30 in the same position in launcher barrel 18 for every launch.

Figure 4:
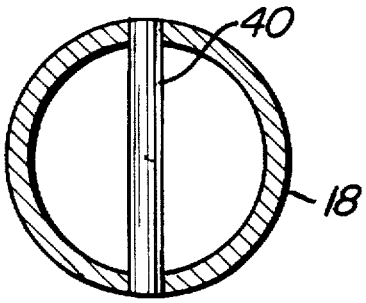
FIG. 4 is an end view of a launcher barrel.

FIG. 4 is an end on view of launcher barrel 18. Pin 40 only blocks a portion of the open space within launcher barrel 18. Launcher barrel 18 may be made of aluminum or other light weight metal. Some plastics could also be used.

Figure 5:
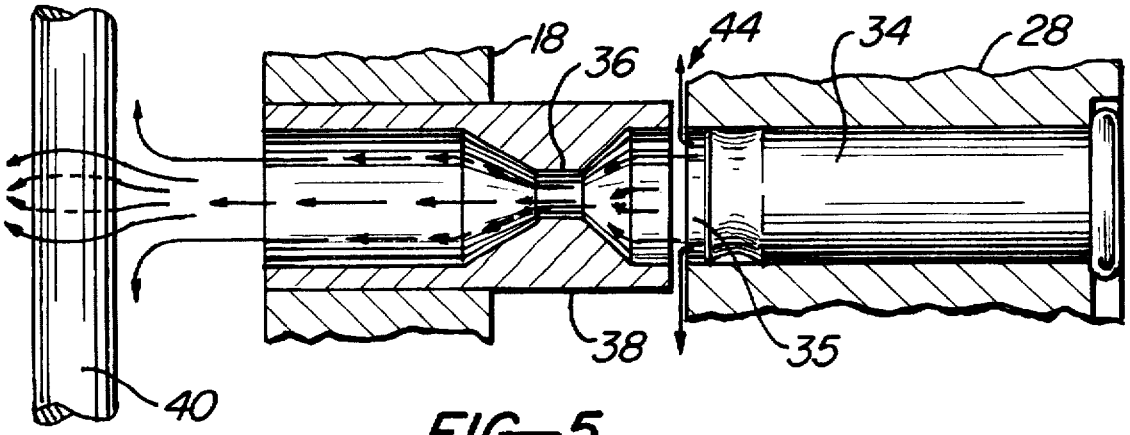
FIG. 5 is a cutaway view of the gas dynamics of the present invention.

FIG. 5 is a cross section of the gas dynamics or gas porting. When blank cartridge 34 fires, the gas travels to orifice 36. Cylinder 28 provides the structural support for blank cartridge 34. Blank cartridge 34 fires when hammer 26 is pulled back and trigger 22 is pulled. When the gas reaches orifice 36 there is a back pressure. Some of the gas leaks out of space 44 between cylinder 28 and launcher barrel 18. This is minimized by a close fit between these parts. After porting through orifice 36, the gas expands and forms a high speed jet that enters plenum 42 at the back of launcher barrel 18. Deflector pin 40 interrupts the jet before it can impact flare 30. If pin 40 were not there, the jet would drill into flare 30 and cause flare 30 to blow out. The deflected jet fills the aft end of launcher barrel 18 with 600 to 700 psi of hot gas. This gas accelerates flare 30 to over 150 feet per second and ignites a delay fuse in flare 30.

What is claimed is:

1. A blank cartridge launcher for a flare comprising:

A. A launcher barrel suitable for holding a flare;

B. a pistol mount attached to said launcher barrel further comprising:

(1) a hand grip, (2) a cockable hammer set in said hand grip, (3) a cylinder rotatably mounted within said pistol mount such that said hammer rotates said cylinder a preset amount whenever said hammer is cocked, (4) A predetermined number of openings each capable of holding a single blank cartridge set in said cylinder such that said preset amount of rotation always causes another opening to align with said hammer, (5) a trigger operably connected to said hammer to cause said hammer to return to its precocked position, (6) a gas duct placed in said pistol mount to permit gas to flow into said launcher barrel from said opening aligned with said hammer; and (7) an orifice of predetermined size set within said gas duct; and C. a pin set within said launcher barrel such that any gas flowing from said opening through said orifice within said gas duct strikes said pin and is deflected into a plenum chamber created in said launcher barrel by the placement of said pin.

2. A blank cartridge launcher for a flare comprising:

A. A launcher barrel suitable for holding a flare;

B. a pistol mount attached to said launcher barrel further comprising:

(1) a hand grip, (2) a cockable hammer set in said hand grip, (3) a trigger operably connected to said hammer; and (4) a cylinder rotatably mounted within said pistol mount such that said trigger rotates said cylinder a present amount whenever said trigger is pulled, (5) a predetermined number of openings each capable of holding a single blank cartridge set in said cylinder such that said preset amount of rotation always causes another opening to align with said hammer, (6) a gas duct placed in said pistol mount to permit gas to flow into said launcher barrel from said opening aligned with said hammer; and (7) an orifice of predetermined size set within said gas duct; and C. a pin set within said launcher barrel such that any gas flowing from said opening through said orifice within said gas duct strikes said pin and is deflected into a plenum chamber created in said launcher barrel by the placement of said pin.

3. A blank cartridge launcher for a flare as described in claim 1, further comprising a trigger guard.

4. A blank cartridge launcher for a flare as described in claim 2, further comprising a trigger guard.

* * * * *